US007168702B1

(12) United States Patent
Shoemaker

(10) Patent No.: US 7,168,702 B1
(45) Date of Patent: Jan. 30, 2007

(54) AMUSEMENT DEVICE OF SKILL AND LOTTERY

(76) Inventor: Stephen P. Shoemaker, 531 N. Francisca Ave., Redondo Beach, CA (US) 90277

( * ) Notice: Subject to any disclaimer, the term of this patent is extended or adjusted under 35 U.S.C. 154(b) by 0 days.

(21) Appl. No.: 11/184,473

(22) Filed: Jul. 19, 2005

(51) Int. Cl.
*A63F 7/00* (2006.01)

(52) U.S. Cl. ..... 273/138.1; 273/445

(58) Field of Classification Search ..... 273/440, 273/441, 445, 459, 138.1, 138.2
See application file for complete search history.

(56) References Cited

U.S. PATENT DOCUMENTS 4,061,334 A * 12/1977 Kanno ..... 273/126 A
5,297,816 A * 3/1994 Becchio ..... 273/459
5,967,515 A * 10/1999 Halliburton ..... 273/138.2
6,206,370 B1 * 3/2001 Halliburton ..... 273/138.1
6,899,328 B2 * 5/2005 Halliburton et al. ..... 273/138.1
2002/0175465 A1 * 11/2002 Halliburton et al. ..... 273/138.1

OTHER PUBLICATIONS

Replay Magazine (ISSN #1534-2328); Dec. 2004; Pg.—Back Cover re 'Slam-A-Winner'; vol. XXX, No. 3; Published monthly by RePlay Publishing, Inc., 18757 Burbank Blvd. #105, Tarzana, CA 91356 (Attached).

* cited by examiner

*Primary Examiner*—Raleigh W. Chiu
(74) *Attorney, Agent, or Firm*—Fulwider Patton LLP

(57) ABSTRACT

An arcade type amusement device is disclosed including a skill portion wherein a projectile such as a token is aimed at a target via a guidance mechanism such as an elongate chute. A deflector may be used to alter the path of the projectile, where the deflector is intermittently present along the trajectory of the projectile so as to require timing to engage the deflector. Upon a successful strike of the target, a ball is released down a helical track toward a rotating playing field interspersed with holes assigned various values. When a ball reaches the rotating playing field, it will rebound and roll until it falls within one of said holes, whereupon a point value is awarded based on the particular value of the hole. The player may receiver redemption tickets or points based on the point value awarded.

12 Claims, 3 Drawing Sheets

AMUSEMENT DEVICE OF SKILL AND LOTTERY

FIELD OF THE INVENTION

The present invention relates generally to amusement games such as those found in arcades and the like, and more particularly to a coin-operated arcade game with a target hitting portion and a lottery-like random reward portion.

BACKGROUND OF THE INVENTION

Arcade games that measure a player's skill and luck are well known in the art. The present inventor is also the inventor and owner of many popular games found in today's' arcades. For example, U.S. Pat. No. 4,272,082, entitled "Coin Projecting Amusement Device," discloses an amusement device wherein coins may be controllably deposited by the player on a playing surface having a multiplicity of surface interruption means thereon. A vertical dam translates over at least a portion of said playing surface and pushes said deposited coins against a random pattern of accumulated coins, causing some of said accumulated coins to fall over an edge into a collecting and counting means. This game is marketed and sold under the trademark "Wedges and Ledges." U.S. Pat. No. 4,303,248, also invented by the present inventor, discloses an amusement game where coins are dropped onto a flat surface over which a vertical dam is horizontally translated. The vertical dam translates over a portion of the flat surface and drops a certain of the accumulated coins over the edge. As the coins drop over the edge, they are collected in a counting chute to be synchronously counted in a memory which is then unloaded to vend out a corresponding number of tokens.

U.S. Pat. No. 4,726,585 also discloses an amusement apparatus in which a player controls a pushing device to push items off of a playing field. A moveable surface is driven in a first pre-determined path and the pusher device is moveable in a linear path traverse to the path travel of the moveable surface. A delivery passage at one end of the path of the pusher device is arranged to deliver any item swept off the surface to a retrieval bin. U.S. Pat. No. 4,822,045 is directed to an amusement device comprised of a pair of spaced apart elongate members defining a track, and a rolling member for rolling along that track under control of an operator. The elongate members are spaced a fixed distance apart at their first ends since this ends comprising since this end comprising the normal home position of the rolling member. The opposite, second ends of the elongate members are moveable relative to one another to adjust their spacing and to control the movement of the rolling member along the track. The operator controls the separation of the elongate member so that the rolling member can roll from its home position to the opposite end of the track without falling between the opening separating the elongate members.

U.S. Pat. No. 5,553,865 discloses a rotary arcade game including a turn table having a central aperture. Prizes are positioned on the surface of the turn table and moved by a pivoting arm member operated by the player. The player attempts to manipulate an arm member to push prizes into a collection pocket where they are detected and dispensed to the player. U.S. Pat. No. 5,855,374 is directed to a crane game using a vacuum to selectively pick up prizes within a bin. The prizes are arrayed on a rotating turn table, and the player manipulates a vacuum pick up device linearly along a radial direction of the turn table to pick up prizes below. U.S. Pat. No. 6,139,429 discloses another crane game using a video screen for displaying images. A maneuverable sensor contacts the display screen to select prizes displayed thereon. U.S. Pat. No. 6,095,519 discloses an arcade game including a directing mechanism for aiming a game piece such as a token. U.S. Pat. No. 6,598,881 discloses a crane game with a prize redistribution mechanism for dispersing prizes to a substantially level configuration. Finally, U.S. Pat. No. 6,770,001 discloses a vacuum crane game with targets having beaded portions that vary the difficulty of acquiring said targets.

Each of the above-identified games are part of an art of amusement devices that have been invented by the present inventor. The present invention is another in the line of games and amusement devices from the inventor.

SUMMARY OF THE INVENTION

The present invention is an arcade-type coin operated game wherein a coin or token is placed in a downwardly inclined and gravity driven chute that propels the token down the chute toward a target. The end of the chute is aimed at a first window or repository corresponding to a failed attempt. That is, if a token is placed in the chute and the token under the influence of gravity rolls down the chute with its path uninterrupted, the token will travel straight into the first window or repository resulting in a failed attempt, ending the game. A second window or repository is located above the first window, and corresponds to a successful or "win" attempt. That is, if token is placed in the chute and then deflected upward into the second window, the player then enters a lottery phase of the game wherein a random reward is assigned. The successful deflection altering the path of the token leaving the chute can be achieved, for example, by a passing a series of ramps across the path of the token so that if timed properly, a token can strike the ramp as it passes by to deflect the token over the fail window and into the success window. The ramps are preferably fixed to a rotating turn table such that the ramps periodically pass before the chute in their circular travel around the turn table.

In the lottery phase of the game, a successful deflection of the token into the win slot is sensed by a sensor, causing a ball to be released from a holding position onto a cycloidal, downwardly spiraling track. The ball rolls down the spiral track until the ball leaves the track and enters a rotating playing field. The rotating playing field includes a number of holes that are sized to receive the ball, such that when the ball enters the rotating playing field it will randomly fall into one of the holes. If each hole is assigned a different point value, then the lottery aspect of the game is accomplished by the ball falling into a random hole, and the player is awarded a reward corresponding to a value associated with the hole.

Other features and advantages of the invention will become apparent from the following detailed description, taken in conjunction with the accompanying drawings which illustrate, by way of example, the features of the invention

DETAILED DESCRIPTION OF THE INVENTION

Figure 1:
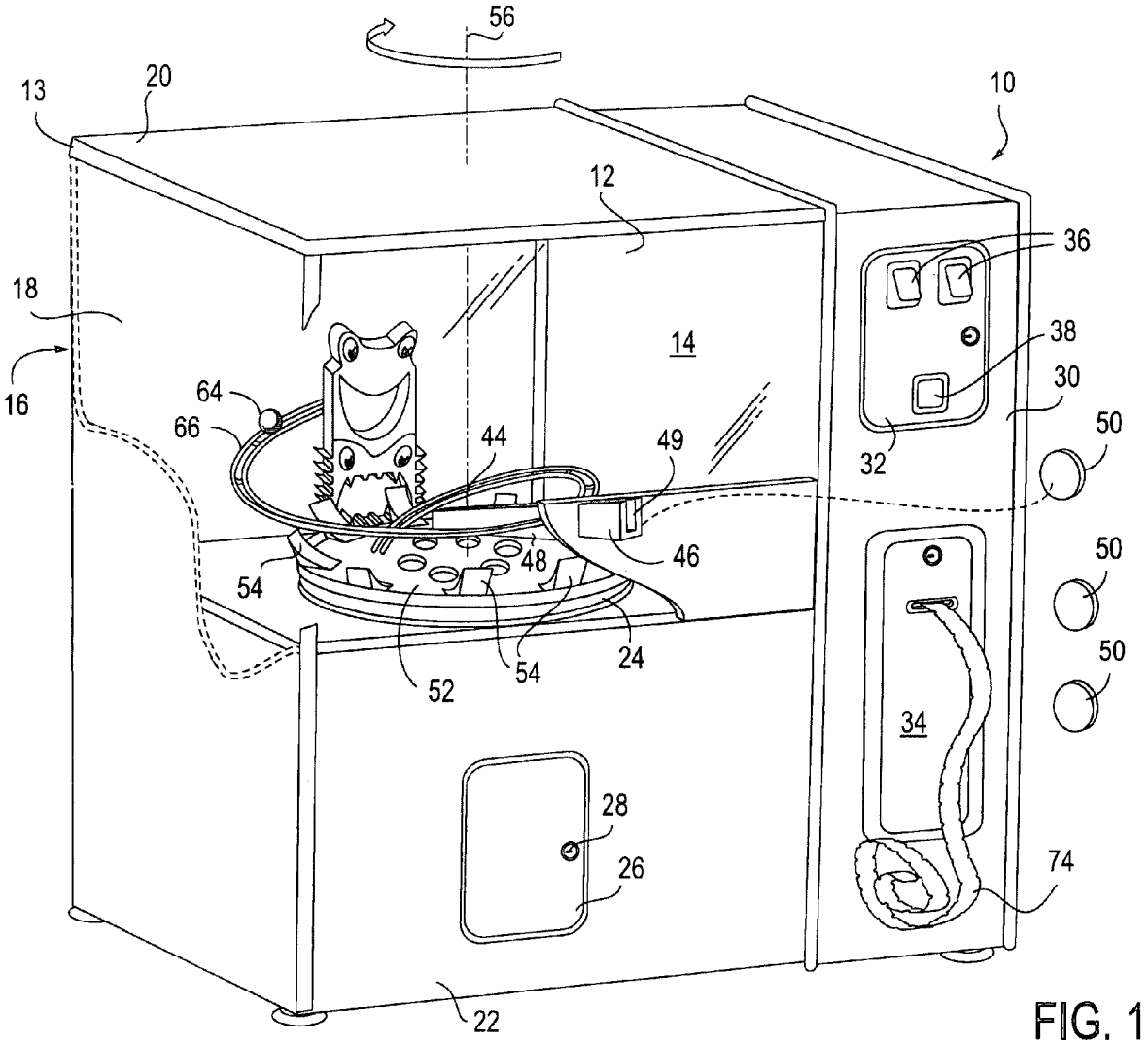
FIG. 1 is an elevated perspective view of a first embodiment of the present invention.

FIG. 1 illustrates an arcade game employing features of the present invention. The game 10 generally includes a housing 13 including three distinct compartments, a playing area compartment 12 enclosed by panels such as transparent front pane 14, rear wall 16, a side wall 18, and a top cover 20. Below the playing area compartment 12 is a storage compartment 22 housing a motor (not shown) for driving a turn table 24 as well as serving as a utility storage area. Access to the storage compartment 22 is available through a door 26 with a lock 28 to secure the contents of the storage compartment 22. The third compartment 30 houses the coin activation mechanism 32 as is known in the art, and a redemption ticket dispensing mechanism 34. The coin activation mechanism 32 includes two coin return buttons 36 and a coin return slot 38. The redemption ticket dispensing mechanism 34 includes a slot 40 through which tickets are dispensed to a player and a lock 42 for securing the contents of the ticket dispenser.

The game is played by placing a coin, token, or other playing piece that either rolls or slides down an incline (hereafter referred to as a token). A chute 44 extends from the playing area compartment 12 through the front pane 14 to define an outer portion 46 and an inner portion 48. A player can place a token 50 in the outer portion 46 of the chute 44 which is sized to receive the token with clearance to allow the token to freely roll down the chute. The inclined orientation of the chute 44 causes the token 50 to roll down the chute into the playing area compartment 12 via the inner portion 48. The chute 44 terminates at the opposite end of a rotating playing field 52 on the turn table 24 having radially oriented ramps 54 disposed on the periphery of the playing field 52 at regular angularly spaced intervals such as every thirty (30) degrees. The playing field 52 constantly rotates about the axis of rotation 56 during the playing of the game, causing the ramps 54 to continuously circle past the chute's distal end 55 and in front of two repositories described below.

Figure 2:
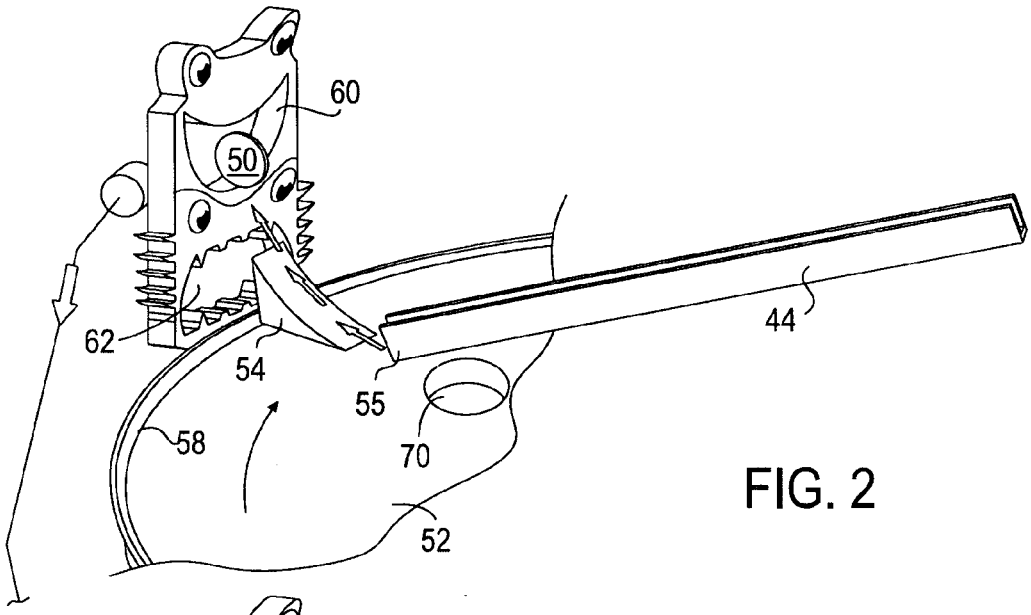
FIG. 2 is an enlarged, cut-away view of the coin chute and rotating turn table of the embodiment of FIG. 1 illustrating a successful attempt to strike a ramp with a token and pass the ramp into the "Win" window.

FIG. 2 illustrates the cooperation of the chute 44, the token 50, and the ramp 54. The chute 44 may be aligned diametrically across the playing field 52 and secured at the center, i.e., the axis of rotation 56, so that the chute 44 will be stationary as the game is played. Alternatively, the chute 44 may be secured to the playing field 52 at a location slightly off center from the axis of rotation 56 causing the chute 44 (and particularly the distal end 55) to oscillate back and forth as the playing field 52 rotates. The chute 44 may also be flexible in construction, permitting the player an opportunity to aim the chute to the left or right by pressing against the outer portion 46 of the chute against the point fixed on the playing field 52, which tends to "bow" or flex the chute and alter the path of the token. A combination of using a flexible chute along with an off-center point of coupling to the playing field 52 adds considerable skill and challenge to the game over the fixed chute. U.S. Pat. No. 6,095,519 by the present inventor is illustrative of the type of chute herein described, and is fully incorporated herein by reference.

As further shown in FIG. 2, a token 50 placed in the chute 44 will roll down the chute and contact the rotating playing field 52. The momentum of the token 50 will carry it to the edge 58 of the playing field 52, where it may or may not encounter a deflector such as a ramp 54 depending on the timing of the token's arrival in conjunction with the rotation of the ramps along the periphery of the playing field 52. The rotation of the ramps intermittently position the ramps along the token's trajectory. For the condition shown in FIG. 2, the token 50 arrives in a timely manner and strikes a ramp 54 at the periphery of the playing field 52. The ramp 54 redirects the token 50 from its original path upward (as indicated by arrows 53) toward a fixed, elevated window or token repository 60 having a sensor such as an optical sensor for example (not shown) for sensing the acquisition of a token 50. The successful timing of the token's arrival with the ramp's intersection along the token's path, causing the token to be deflected by the ramp 54 into the elevated repository 60, is deemed a "Win" in terms of the object of the game. A "Win" can be achieved by placing the token 50 into the slot 49 at the appropriate moment (and/or altering the shape of the chute when a flexible chute is employed) so that it will arrive at the periphery of the playing field 52 coinciding with the appearance of a ramp to deflect the coin upward—a skill that can be refined with practice.

Figure 3A:
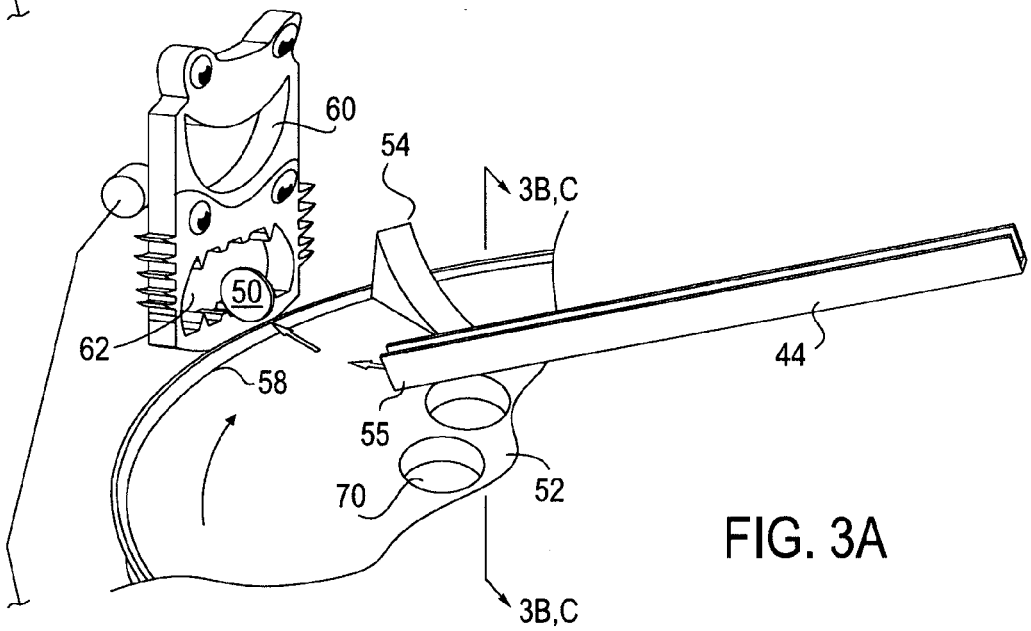
FIG. 3A is the cut-away view of the coin chute and rotating turn table of FIG. 2 illustrating an unsuccessful attempt to strike a ramp with a token leading the token to pass through the "Lose" window.
Figure 3B:
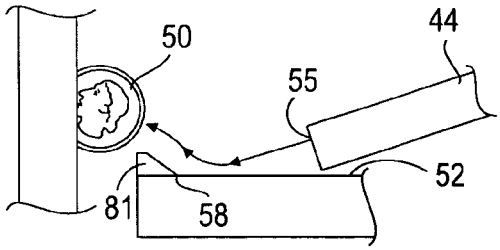
FIG. 3B is an enlarged, profile view of the turn table and peripheral lip illustrating a coin bouncing over the lip into the "Lose" window.
Figure 3C:
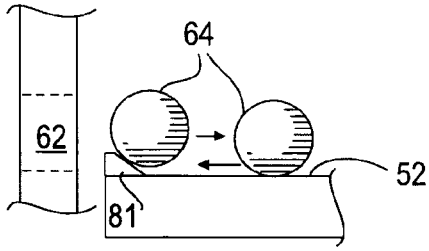
FIG. 3C is an enlarged, profile view of the turn table and peripheral lip illustrating a ball being kept on the turn table surface by the lip.

FIG. 3 illustrates the condition where an unsuccessful attempt leads to the token 50 missing a ramp 54 and rolling into a "Lose" repository 62. Simply, if the player's timing is off and the ramp 54 is missed, the token 50 will roll directly across the playing field 52 to a repository 62 that is not elevated substantially from the level of the playing field 52 (see FIG. 3B). In this case, the game ends and the player must try again with another token.

If a player successfully achieves a "Win" and lands a token in the repository 60, a second portion of the game is initiated wherein a relay controlled by a processor operates a ball release to send a ball 64 rolling down a helical track 66 encircling the playing field 52 from above. A release mechanism 65 is coupled to the sensor in the "Win" repository 60 such that a successful play will automatically result in a ball 64 being released down the helical track 66. The track 66 includes a start position 68 above the outer edge 58 of the playing field 52 and winds inwardly and downwardly in a spiral manner terminating just above the playing field 52. A ball return mechanism (not shown) collects the balls below the table and returns the ball(s) to the start position 68 after each successful play. A ball return assembly such as those used to return a pinball to the plunger, for example, can be used to return a ball below the table to the start position after each game.

Figure 4:
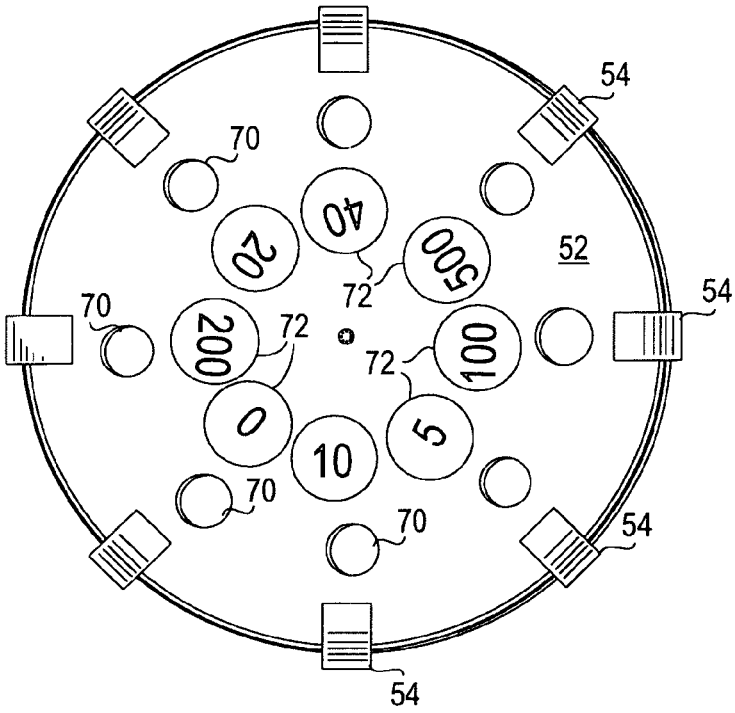
FIG. 4 is a top view of the turn table illustrating the scoring holes and ramps.
Figure 5:
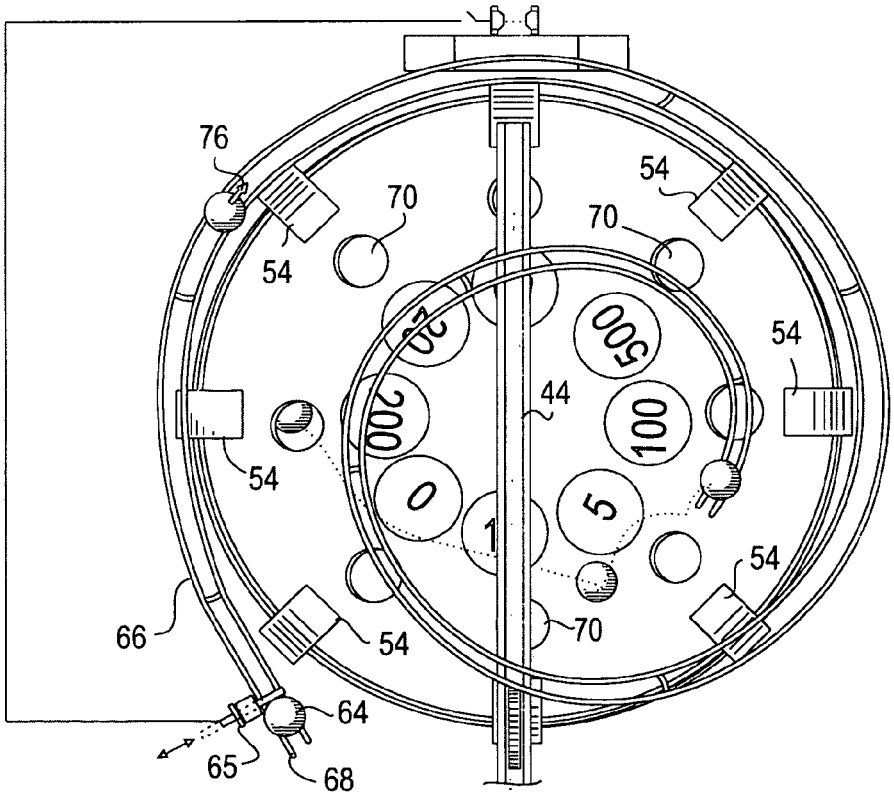
FIG. 5 is a top view of the turn table along with the helical ramp and ball entering the turn table.

As shown in FIG. 4, the playing field 52 includes a plurality of circumferentially spaced holes 70 with stickers 72 or other demarcations indicating varying point values for the respective holes 70. When a ball 64 is released from the start position 68 of the helical track 66, it will roll down the track 66 as indicated in FIG. 5 by the arrow 76, around the game until it reaches the playing field 52. Once the ball reaches the playing field 52, it will bounce, roll, and carom off elements of the game until the ball eventually falls into one of the holes 70. A circumferential lip 81 (see FIG. 3C) along the playing field's periphery, or a rail placed around the periphery, retains the ball on the surface of the playing field 52 until it falls within a hole 70. The playing field 52 can also be shaped or sloped toward the center to ensure that the balls will eventually reach a hole and not be driven to the outer edges of the playing field 52 due to centripetal forces caused by the rotation of the table. The holes 70 are sized so that the ball 64 will fall through, thereby energizing a sensor (not shown) that sends a signal to the redemption ticket dispenser 34. Tickets 74 are then dispensed to the player via the slot 40 based on the value assigned to the specific hole 70 through which the ball 64 falls. That is, if the ball falls through a hole designated as 200 points, then two hundred tickets are a value equivalent thereof is distributed to the player. Of course, the actual scoring and reward system can be altered in many ways without departing from the scope of the present invention. The just described portion of the game is essentially a lottery in which random chance guides the selection of which hole the ball falls into, and consequently the reward to the player.

The game as described above can be played in various forms without departing from the scope of the present invention. For example, the roles of the token repositories 60 and 62 can be switched, or the ball can be replaced with an object that slides instead of rolls. The ramps around the periphery of the rotating playing field can be replaced by another device for deflecting the tokens, and the holes in the playing field could be replaced by cups or other mechanisms for capturing the rolling ball(s). Thus, it may be appreciated that there are many ways to practice the present invention other than the exemplary mode described above, which corresponds to the inventor's best known mode. The description above should not be interpreted as limiting the scope of the invention other than as expressly provided for, and the invention's breadth should be governed solely by the words of the appended claims below.

I claim:

1. An amusement device of skill and chance comprising:

a housing including a viewing surface;

a playing field located within the housing, said playing field including a reward system employing a randomly moving object thereon for selecting a value from among a set of values;

a moving object delivery mechanism that delivers said moving object to the playing field;

a player-operated projectile guidance device for delivering a projectile toward said playing field along a trajectory;

a projectile repository defining a target;

a projectile deflector intermittently disposed along said trajectory for deflecting a projectile; and;

a control system for actuating said moving object delivery mechanism to deliver said moving object onto toward said playing field only after a projectile has hit said target.

2. The amusement device of claim 1 wherein said playing field continuously rotates while the game is being played.

3. The amusement device of claim 1 wherein said playing field is comprised of a plurality of holes adapted to receive said moving object, where each hole is assigned a different value.

4. The amusement device of claim 1 wherein the moving object is a ball.

5. The amusement device of claim 1 wherein the moving object delivery mechanism includes a helical track for communicating the moving object to the playing field.

6. The amusement device of claim 1 wherein the player-operated projectile guidance device comprises an elongate chute sized to receive said projectile therein.

7. The amusement device of claim 6 wherein said elongate chute comprises a first end external to said housing and elevated from a second end internal to said housing.

8. The amusement device of claim 7 wherein said projectile is a token.

9. The amusement device of claim 1 wherein said projectile deflector is a ramp passing between said target and said projectile guidance device.

10. The amusement device of claim 1 further comprising a ticket dispenser that dispenses tickets according to a value selected by said reward system.

11. The amusement device of claim 1 wherein said projectile guidance device may be coupled to said playing field, wherein rotation of said playing field causes said projectile guidance device to oscillate.

12. An amusement device of skill and chance comprising:

a housing including a transparent front panel;

a rotating playing field located within the housing, said rotating playing field including a reward system employing a ball rolling thereon for selecting a value from among a set of values;

a ball delivery mechanism that delivers said ball to the playing field comprising a helical track leading from a start position elevated from said rotating playing field to an end position at said rotating playing field;

an elongate token chute for communicating a token toward said rotating playing field along a trajectory;

a token repository offset from said projectile trajectory and defining a target, said token repository including a sensor for detecting the entrance of a token into said repository;

a plurality of ramps oriented radially outward at an edge of said rotating playing field so as to intermittently pass in front of said chute, wherein said ramps are adapted to deflect a token exiting said chute into said token repository; and;

a control system for releasing a ball onto said helical track toward said rotating playing field only after the sensor detects that a token has entered the token repository.

* * * * *